United States Patent [19]

Kerr

[11] 4,226,450

[45] Oct. 7, 1980

[54] GATE LATCH

[75] Inventor: Kenneth G. Kerr, Timboon, Australia

[73] Assignees: Ada M. Kerr; Alan G. Kerr, both of Timboon; Keith E. Kerr, Cobden; Bruce K. Kerr; Colin F. Kerr, both of Timboon, all of Australia

[21] Appl. No.: 936,727

[22] Filed: Aug. 25, 1978

[30] Foreign Application Priority Data

Aug. 25, 1977 [AU] Australia ..... PD1379
Oct. 21, 1977 [AU] Australia ..... PD2149

[51] Int. Cl.[3] ..... E05C 3/40
[52] U.S. Cl. ..... 292/59
[58] Field of Search ..... 292/59, 213, 214, 216, 292/280, 218, DIG. 15

[56] References Cited

U.S. PATENT DOCUMENTS

| | | | |
|---|---|---|---|
| 329,894 | 11/1885 | Evans | 292/213 X |
| 538,078 | 4/1895 | Kerler | 292/78 |
| 1,194,786 | 8/1916 | Ross | 292/216 |
| 1,269,145 | 6/1918 | Wright et al. | 292/216 |
| 1,469,800 | 10/1923 | McCleeary | 292/216 |
| 1,896,909 | 2/1933 | Maxwell | 292/216 X |

FOREIGN PATENT DOCUMENTS 63092 8/1913 Austria .

*Primary Examiner*—Richard E. Moore
*Attorney, Agent, or Firm*—Wigman & Cohen

[57] ABSTRACT

A gate latch is described comprising a tubular support, a latch member having a shaft portion mounted within said tubular support for rotation therein and a latch portion extending axially outwardly from said shaft portion having at least two peripherally, substantially equispaced, projections extending axially outwardly from said shaft portion, said spacing being such as to permit entry between adjacent projections of a complemental gate locking bar extending from a complemental gate, said locking bar having locking means at its free end to engage one or other of said adjacent projections to lock the gate relative to said tubular support.

A combination of the above gate latch and the complemental gate locking bar and gate described above is also disclosed.

9 Claims, 6 Drawing Figures

GATE LATCH

BACKGROUND OF THE INVENTION

This invention relates to gate latches.

OBJECTS AND SUMMARY OF THE INVENTION

The principal objective of this invention is to provide a gate latch which is self-locking upon the gate being closed and which can be easily opened by a simple manual operation.

Accordingly, the present invention provides in its broadest aspect, a gate latch comprising a tubular support, a latch member having a shaft portion mounted within said tubular support for rotation therein and a latch portion extending axially outwardly from said shaft portion having at least two peripherally, substantially equispaced, projections extending axially outwardly from said shaft portion, said spacing being such as to permit entry between adjacent projections of a complemental gate locking bar extending from a complemental gate, said locking bar having locking means at its free end to engage one or other of said adjacent projections to lock the gate relative to said tubular support.

Conveniently, the projections may extend from a base member adapted to sit on said tubular support. Advantageously, the base member may have three axially outwardly extending projections, any two of which will be engaged by the gate locking bar to retain the same between said projections.

Preferably, the latch member may comprise a handle attached at a convenient location to enable manual rotation of the member relative to the tubular support to free the locking bar from the latch.

The latch member may also have complemental abutment means on the tubular support and latch member to limit the relative rotation of the latch member.

The shaft portion of the latch member may advantageously have bearings or bearing-like means at each end thereof to enhance relative rotation of said latch member.

According to another aspect of the invention, there is provided a gate latch, as described hereinabove, in combination with a gate having a locking bar thereon, said bar having means associated therewith for engaging one of the projections and to cause retention between one and the adjacent projection to lock the gate relative to the tubular support.

The locking means associated with said locking bar may conveniently take the form of an arcuate cap mounted on the outer end of the locking bar.

The invention also provides a modification of the gate latch disclosed hereinabove which renders the gate latch more secure, particularly more secure for small children.

According to the broadest aspect of the aforementioned modification of the invention, the latch member is resiliently mounted within the tubular support and has means associated therewith to co-operate with complemental means on the tubular support or a further inner tubular member so as to form a bayonet joint therebetween to lock the latch member when said latch member has rotated to its extremity as a result of striking by the gate lock bar.

Thus the latch member may be provided with at least one radially outwardly extending projection adapted to engage a complemental slot or recess in the opposed tubular support or other opposed tubular surface, said slot being shaped such that locking of the projection and thus the latch member occurs when the latch member has rotated to its extremity as a result of striking by the gate lock bar.

As suggested above, the slot or recess may be located either in the tubular support itself or in a further inner tubular member located within the tubular support.

The resilient means may conveniently consist of a compression spring located beneath the latch member and advantageously retained within the further inner tubular member.

BRIEF DESCRIPTION OF THE DRAWING

The invention will now be described and illustrated with reference to a number of preferred embodiments shown in the accompanying drawings, wherein.

DETAILED DESCRIPTION OF PREFERRED EMBODIMENTS

Figure 1:
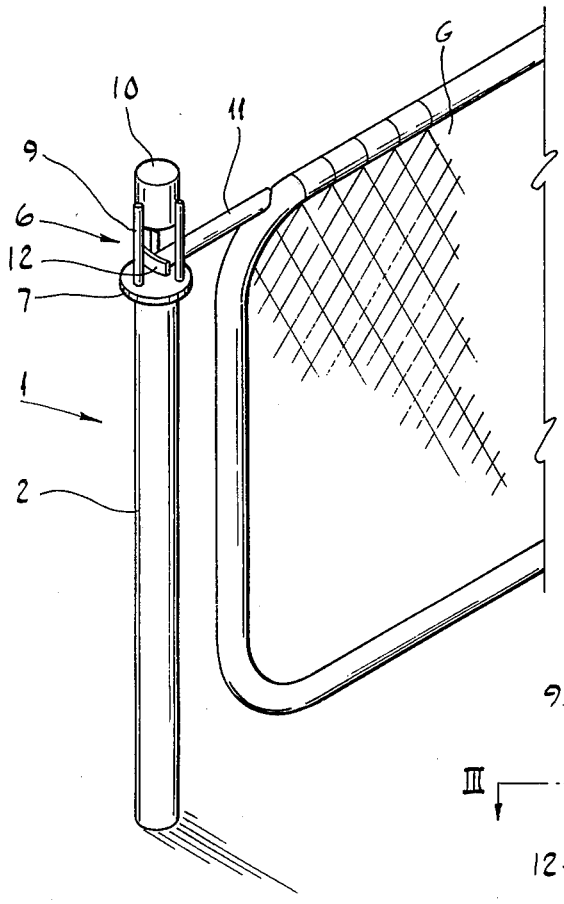
FIG. 1 is a perspective view, in part, which shows a gate latch according to this invention in working relation with a gate having a complemental gate locking bar thereon, the bar being in the captive position.
Figure 3:
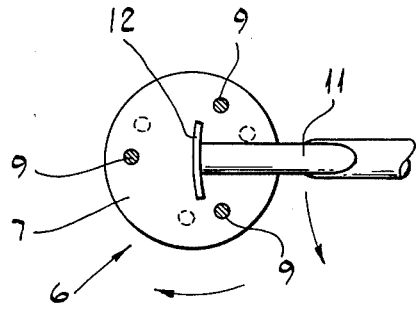
FIG. 3 shows a cross-sectional view along line III—III of FIG. 2.
Figure 2:
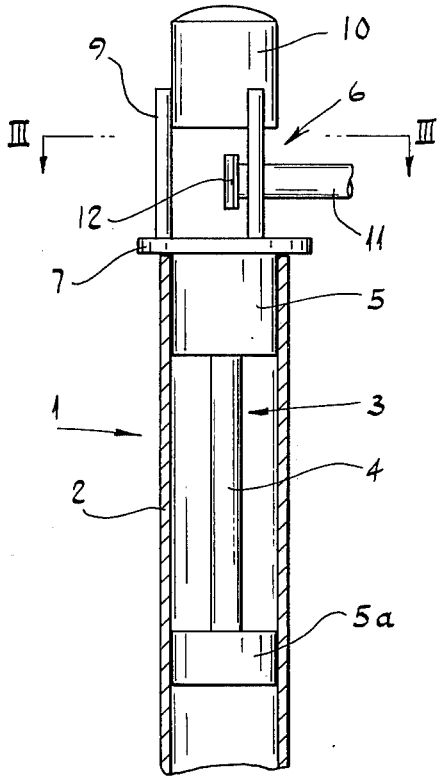
FIG. 2 is a part cross-sectional view in elevation of the gate latch shown in FIG. 1, also showing the gate locking bar in its captive position.

Referring to FIGS. 1 to 3 of the drawings, a gate latch, generally indicated as 1, comprises a tubular support or hollow cylindrical gate post 2 which houses the shaft portion 4 of the latch member generally indicated as 3. The shaft portion 4 has two widened sections 5, 5*a* at each end thereof which act as bearings to facilitate rotation of the latch member 3 within the gate post 2.

The latch member 3 has a latch portion, generally designated 6, extending axially outwardly from said shaft portion 4 and consisting of a radially outwardly extending base plate 7, the plate being adapted to sit on the top of the gate post 2 and has three circumferentially equi-spaced prongs 9 projecting from the plate 7 terminating in a dome-shaped cap 10.

The latch portion 6, more particularly the prongs 9, of the rotatable latch member 3 are adapted to co-operate with a gate locking bar 11 attached to the top of a gate G upon closure of the gate. The complemental gate locking bar has a convexely curved hooking cap 12 at its free end adapted for engagement with any of the prongs 9 to arrest angular movement of the gate locking bar 11 and hence the gate.

Figure 4:
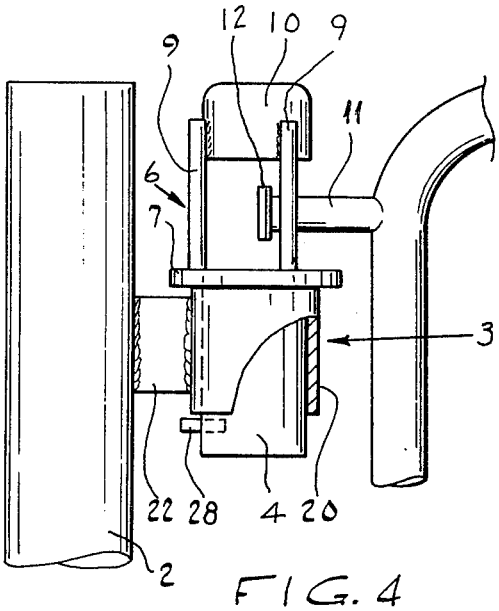
FIG. 4 shows another embodiment of the gate latch of this invention.

Referring to FIG. 4 which shows another embodiment in the drawings, a spacing plate 22 is located between fence post 2 and tubular support 20 (in the form of a bush) and attached hereto. Tubular support 20 houses the shaft portion 4 of the latch member 3 which has a constant cross-section (no widened portions 5, 5*a*) along its length and is conveniently of tubular configuration. The shaft portion 4 extends beyond the wall of the tubular support 20 and has a removable pin 28 located at its lower free end to prevent removal of the latch member 3 from support 20.

In use, when the gate is moved into the closed position, the gate locking bar 11 strikes one of the upstanding prongs 9 causing rotational movement thereof to a position where the arcuate movement of the gate locking bar and the circular movement of the prong intersect and at that point the arcuate movement of the locking bar is arrested by virtue of the prong engaging the convexly curved hooking cap 12. It will be appreciated that the above mechanism results in an effective locking of the gate G relative to the gate post 2 as any unlocking of the gate G by reversing the angular movement of the gate G (and gate locking bar 11) is impossible by virtue of the gate locking bar 11 hooking onto the adjacent prong 9 when that prong 9 and the locking bar 11 move in the opposite direction and their lines of movement intersect.

Unlocking of the gate G is effected by manual rotation of the latch member 3 either by means of an optional handle or cap 10 mounted on said member 3 or by simply twisting the latch member 3 to a position where one of the operative prongs 9 contacts the gate locking bar 11 in which position of the latch member 3 the gate locking bar 11 can be angularly removed therefrom.

According to another embodiment (not shown) of the invention, the gate latch 1 may be used to cooperate with a slidable door or gate G in which case the locking bar 11 will extend laterally, rather than longitudinally as shown in the drawings, from a side of the gate S or door so as to engage the prongs 9 of the latch member 3 in a manner described hereinabove.

It will also be appreciated from the above that the present invention provides a very effective self-locking gate latch which gate latch 1 can be very effectively and simply unlocked by simple manual rotation of the latch member 3.

Figure 5:
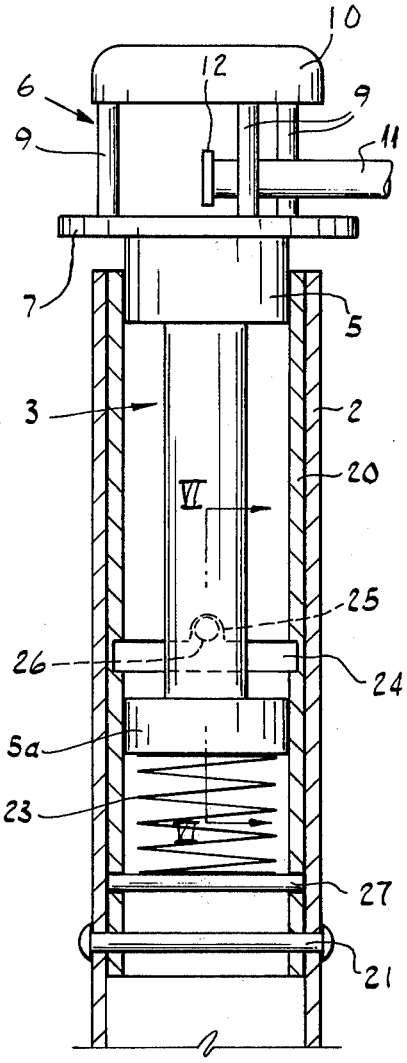
FIG. 5 shows yet a further embodiment of the gate latch of the invention.
Figure 6:
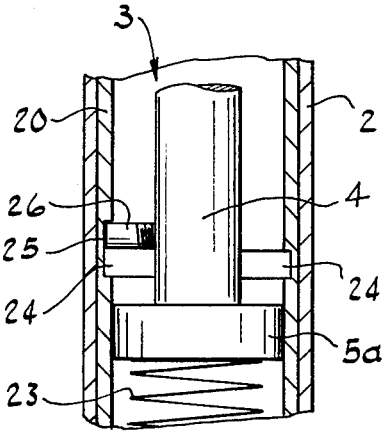
FIG. 6 is a sectional view along line II—II in FIG. 5.

Referring to FIGS. 5 and 6 which illustrate a third embodiment in the drawings, the tubular support 20 is rigidly mounted, advantageously by means of pin 21, within the gate post 2. Tubular support 20 supports a compression spring 23 by means of adjustable pin 27, the spring 23 in turn supporting the latch member 3.

Latch member 3 has at least one outwardly extending set screw 26 on its periphery.

The tubular support 20 has an elongated peripheral slot 24 with a lateral extension 25 adapted to accommodate the set screw 26 and to permit the screw 26 to move therewithin.

When the gate locking bar 11 strikes the projection 9 of the latch member 3, and the latter reaches its angular extremity, the set screw 26, after moving within slot 24, moves into the lateral extension 25 of slot 24 with the aid of the compression spring 23, thus locking the latch member relative to the tubular support 20.

The latch member 3, and thus the gate G, is released by depressing and twisting the latch member 3 so that the set screw 26 is removed from the slot extension 25 and can move freely within the slot 24.

We claim:

1. A gate latch comprising a tubular support, a latch member having a shaft portion mounted within said tubular support for rotation therein and a latch portion extending axially outwardly from said shaft portion having at least three peripheral adjacent projections being equispaced from each other and extending axially outwardly from said shaft portion, a complemental gate locking bar extending from a gate having locking means at its free end to engage the latch portion within the space defined by said at least three adjacent projections to lock the gate relative to said tubular support, said projections being so equispaced such as to permit entry between adjacent projections of the complemental gate locking bar.

2. A gate latch as claimed in claim 1, wherein said latch portion has a base member adapted to sit on said tubular support, said base member having the at least three projections axially outwardly extending therefrom.

3. A gate latch as claimed in claim 1 or 2, comprising a handle means, attached to said latch member, for enabling manual rotation of the latch member relative to the tubular support in order to free the locking bar from the latch portion.

4. A gate latch as claimed in claim 1 or 2, comprising bearings or bearing-like means at each end of the shaft portion.

5. A gate latch as claimed in claim 1 or 2, wherein said latch member extends beyond the tubular support at its free end.

6. A gate latch as claimed in claim 1 or 2, further comprising abutment means, provided at a lower protruding end of the latch member, for preventing removal of the latch member from the tubular support.

7. A gate latch comprising a tubular support, a latch member having a shaft portion mounted within said tubular support for rotation therein and a latch portion extending axially outwardly from said shaft portion having at least three peripheral adjacent projections being equispaced from each other and extending axially outwardly from said shaft portion, said projections being so equispaced such as to permit entry between adjacent projections of a complemental gate locking bar extending from a complemental gate, said locking bar having locking means at its free end to engage one or other of said adjacent projections to lock the gate relative to said tubular support, wherein the latch member is resiliently mounted within the tubular support and has means associated therewith to cooperate with complemental means on the tubular support so as to form a bayonet joint therebetween to lock the latch member when said latch member has rotated to its extremity as a result of striking by the gate lock bar.

8. Modification as claimed in claim 7, wherein the latch member is provided with at least one radially outwardly extending projection adapted to engage a complemental slot or recess in the opposed tubular support or other opposed tubular surface, said slot being shaped such that locking of the projection and thus the latch member occurs when the latch member has rotated to its extremity as a result of striking by the gate lock bar.

9. Modification as claimed in claim 7, wherein the resilient means consist of a compression spring located beneath the latch member.

* * * * *